US008459195B2

(12) United States Patent
Irving

(10) Patent No.: US 8,459,195 B2
(45) Date of Patent: Jun. 11, 2013

(54) SELF LOAD SENSING CIRCUIT BOARD CONTROLLER DIAPHRAGM PUMP

(76) Inventor: Michael H. Irving, Haverhill, MA (US)

( * ) Notice: Subject to any disclaimer, the term of this patent is extended or adjusted under 35 U.S.C. 154(b) by 125 days.

(21) Appl. No.: 13/096,107

(22) Filed: Apr. 28, 2011

(65) Prior Publication Data

US 2012/0272886 A1 Nov. 1, 2012

(51) Int. Cl.
*B63B 13/00* (2006.01)

(52) U.S. Cl.
USPC ..... 114/183 R

(58) Field of Classification Search
USPC ..... 114/283 R, 183 R
See application file for complete search history.

(56) References Cited

U.S. PATENT DOCUMENTS

| | | | | |
|---|---|---|---|---|
| 4,567,544 | A * | 1/1986 | Ronemus et al. | 361/753 |
| 4,620,835 | A | 11/1986 | Bell | |
| 5,056,036 | A | 10/1991 | Van Bork | |
| 5,404,048 | A | 4/1995 | Panner | |
| 5,549,456 | A | 8/1996 | Burrill et al. | |
| 5,570,715 | A | 11/1996 | Featheringill et al. | |
| 5,752,384 | A | 5/1998 | Schmitt et al. | |
| 6,254,350 | B1 | 7/2001 | Koenig et al. | |
| 6,261,065 | B1 | 7/2001 | Nayak et al. | |
| 6,837,174 | B1 * | 1/2005 | Baurley | 114/183 R |
| 7,841,286 | B1 * | 11/2010 | Bochenski | 114/183 R |
| 2002/0141874 | A1 | 10/2002 | Schoenmeyer | |
| 2003/0049134 | A1 * | 3/2003 | Leighton et al. | 417/40 |
| 2004/0009075 | A1 | 1/2004 | Meza et al. | |
| 2004/0013539 | A1 | 1/2004 | Takagi et al. | |
| 2006/0152995 | A1 | 7/2006 | Kreutzer | |
| 2008/0094763 | A1 | 4/2008 | Tharp | |
| 2009/0123295 | A1 | 5/2009 | Abbott | |
| 2010/0052582 | A1 * | 3/2010 | Virtanen et al. | 318/400.07 |

FOREIGN PATENT DOCUMENTS

| | | |
|---|---|---|
| JP | 57208378 | 12/1982 |
| RU | 2353810 | 4/2009 |
| WO | 9214930 | 9/1992 |
| WO | 9509305 | 4/1995 |
| WO | 03008806 | 1/2003 |

OTHER PUBLICATIONS

JP57208378 English Language Translation of Abstract, Dec. 1982.
RU2353810 English Language Translation of Abstract, Apr. 2009.

* cited by examiner

*Primary Examiner* — Stephen Avila

(57) ABSTRACT

A self-priming diaphragm pump is connected to a circuit board which activates the self-priming diaphragm pump at predetermined intervals, e.g., for 1-3 seconds. When the self-priming diaphragm pump is activated, the circuit board senses the amperage draw from the pump's motor and either continues to run the pump or stops the pump depending on the different amperage levels read. If there is water present in the bilge, the motor is working harder, requiring more amperage and circuit board keeps the pump running. If there is no water present for the pump to draw, the amperage load is very low and the circuit board shuts the pump off, retesting it in the predetermined interval.

18 Claims, 2 Drawing Sheets

Figure 1a
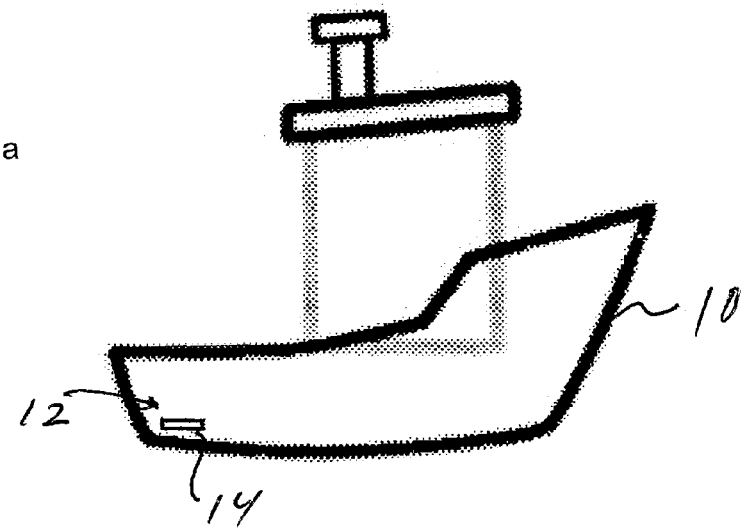
Figure 1b
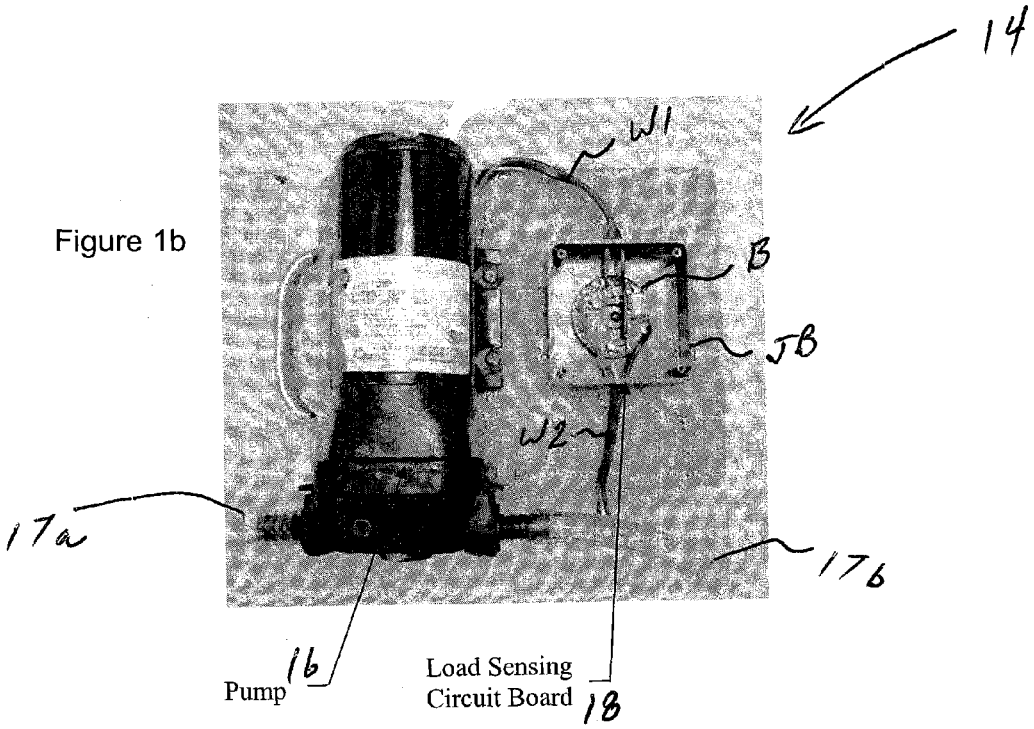
Figure 1

SELF LOAD SENSING CIRCUIT BOARD CONTROLLER DIAPHRAGM PUMP

BACKGROUND OF THE INVENTION

1. Field of the Invention

This invention relates to a pump; and more particularly, relates to a circuit board for controlling a diaphragm pump.

2. Description of Related Art

Current boat owners typically use bilge pumps, either centrifugal, impeller or diaphragm style, which utilize an exterior float switch to automatically activate the pump. Most exterior switches turn off the pump prematurely, allowing ¼" to 1" of water remaining in the bilge.

Other known bilge pumps have systems that promote dry bilges with pumps, e.g. by using a build-up of negative pressure in a vacuum tank to draw water out of the bilge. However, these bilge pumps are costly and large.

There is no current technology that uses a diaphragm pump (or other self priming pump) attached to a circuit board that senses amperage draw on the motor to remove water in bilge applications.

SUMMARY OF THE INVENTION

The present invention provides a new and unique system comprised of, e.g., a self-priming diaphragm pump connected to a load sensing circuit board which activates the self-priming diaphragm pump at predetermined intervals for 1-3 seconds. When the self-priming diaphragm pump is activated, the load sensing circuit board senses the amperage draw from the pump's motor and either continues to run the pump or stops the pump depending on the different amperage levels read. If there is water present in the bilge, the motor is working harder, requiring more amperage and circuit board keeps the pump running. If there is no water present for the pump to draw, the amperage load is very low and the circuit board shuts the pump off, retesting it in the predetermined interval.

In its broadest sense, according to some embodiments, the invention may take the form of apparatus comprising: a signal processing module configured with at least one processor and at least one memory including computer program code, where the at least one memory and computer program code are configured, with the at least one processor, to cause the apparatus at least to:

provide the signaling to activate a pump at the predetermined intervals, and receive a signal containing information about an amperage draw from a motor of the pump when the pump is activated and either (1) continue to run the pump or (2) provide the corresponding signaling to stop the pump from running based at least partly on the signal received that contains information about the amperage draw sensed.

According to some embodiments of the present invention, the signal processing module may form part of a load sensing circuit board that is configured to couple to the pump.

According to some embodiments of the present invention, the load sensing circuit board may be configured to activate the pump at predetermined intervals, e.g., for 1-3 seconds, although the scope of the invention is not intended to be limited to any particular interval of time.

According to some embodiments of the present invention, the pump may take the form of a diaphragm pump, including a self-priming diaphragm pump, although the scope of the invention is intended to include other types or kinds of pumps either now known or later developed in the future.

According to some embodiments of the present invention, the apparatus may take the form of a bilge pump system comprising a combination of a pump and a signal processing module, where the pump has a motor, is configured to respond to signaling to be activated at predetermined intervals, and also is configured to respond to corresponding signaling to be deactivated; and where the signal processing module is configured with at least one processor and at least one memory including computer program code, and the at least one memory and computer program code are configured, with at least one processor, to cause the signal processing module at least to:

provide the signaling to activate the pump at the predetermined intervals, and receive a signal containing information about an amperage draw from the motor when the pump is activated and either (1) continue to run the pump or (2) provide the corresponding signaling to stop the pump from running based at least partly on the signal received that contains information about the amperage draw sensed.

The apparatus may also be configured with one or more of the features discussed above.

According to some embodiments of the present invention, the apparatus may take the form of a vessel, including a motor boat, a sail boat, a cargo ship, a tug boat, catamaran, etc., where the vessel comprises a bilge and a bilge pump system; where the bilge is formed at the lowest compartment on the vessel or is located where the two sides of the vessel meet at the keel; and where the bilge pump system is configured with a pump and a signal processing module, either the bilge pump system or the pump is configured in the bilge, the pump has a motor and is configured to respond to signaling to be activated at predetermined intervals, and is also configured to respond to corresponding signaling to be deactivated; and where the signal processing module is configured with at least one processor and at least one memory including computer program code, and the at least one memory and computer program code are configured, with the at least one processor, to cause the signal processing module at least to:

provide the signaling to activate the pump at the predetermined intervals, and receive a signal containing information about an amperage draw from the motor when the pump is activated and either (1) continue to run the pump or (2) provide the corresponding signaling to stop the pump from running based at least partly on the signal received that contains information about the amperage draw sensed.

The apparatus may also be configured with one or more of the features discussed above.

Using the load sensing circuit board technology according to some embodiments of the present invention, the vessel owner can remove as much as 99.9% of the water from the bilge of the vessel.

The bilge pump according to the present invention is much smaller than known bilge pumps and uses the pump's reaction to water to indicator instead of some random vacuum intervals.

These and other features, aspects, and advantages of embodiments of the invention will become apparent with reference to the following description in conjunction with the accompanying drawing. It is to be understood, however, that the drawing is designed solely for the purposes of illustration and not as a definition of the limits of the invention.

BRIEF DESCRIPTION OF THE DRAWING

The drawing, which is not necessarily to scale, include the following Figures:

FIG. 1 includes FIGS. 1*a* and 1*b*, where FIG. 1*a* shows a diagram of a vessel having a bilge pump system according to some embodiments of the present invention, and where FIG. 1*b* shows a bilge pump system shown in FIG. 1*a* according to some embodiments of the present invention.

Figure 2:
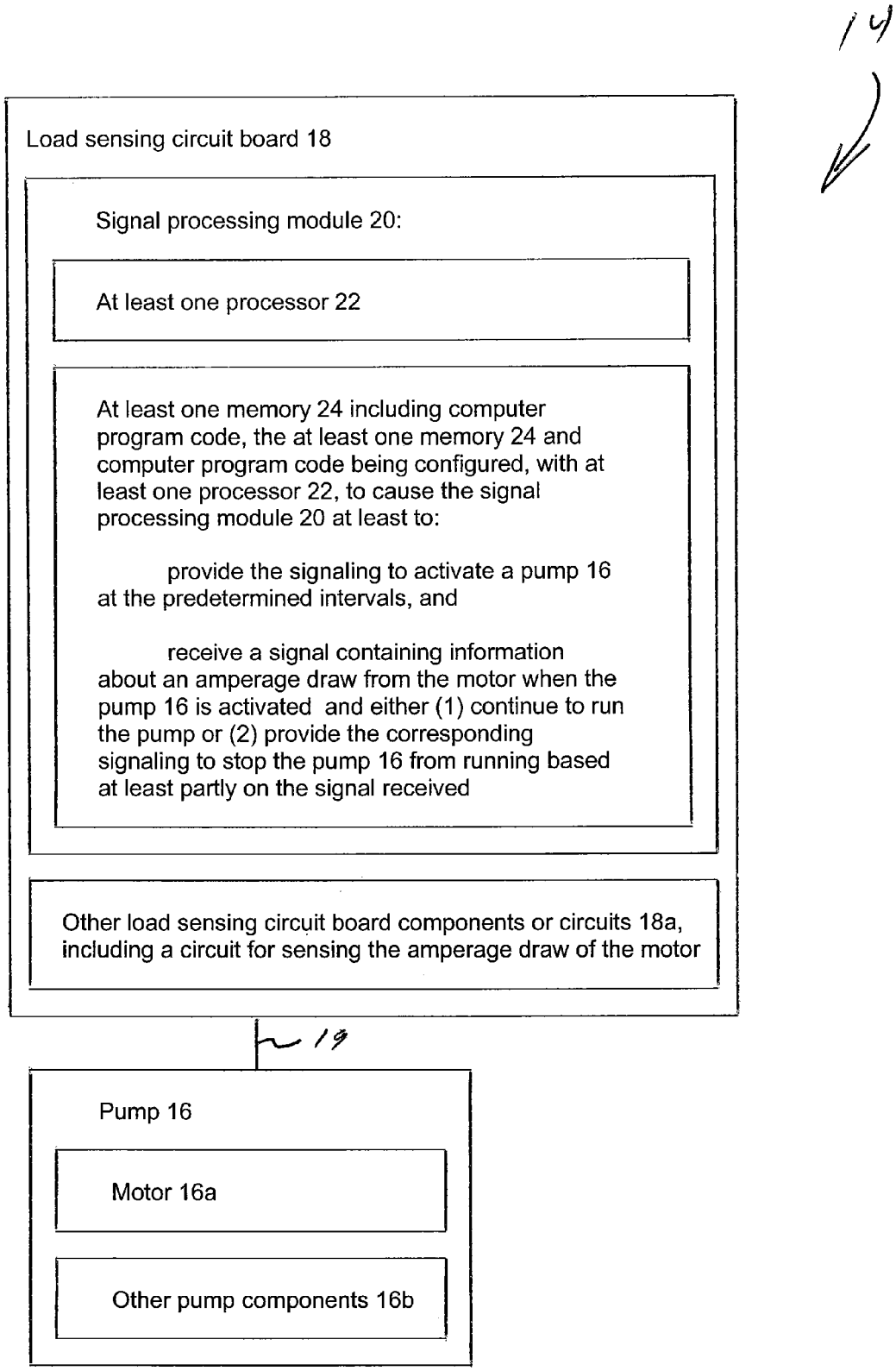
FIG. 2 shows a block diagram of a load sensing circuit board in relation to a pump according to some embodiments of the present invention.

In the following description of the exemplary embodiment, reference is made to the accompanying drawing, which form a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

FIG. 1*a* shows a vessel 10, such as a motor boat, a sail boat, a cargo ship, a tug boat, catamaran, etc., that has a bilge generally indicated by the arrow 12 with a bilge pump system 14 according to the present invention. The bilge pump system 14 may be configured or arranged in the bilge 12, e.g., that is understood to be formed at the lowest compartment on the vessel 10 or is located where the two sides of the vessel 10 meet at the keel.

FIGS. 1*b* and 2 shows the bilge pump system 14 configured with a pump 16 and a load sensing circuit board 18. In FIG. 1*b*, the pump 16 is shown coupled to hosing 17*a*, 17*b* for drawing in water from the bilge 12 and providing the water, e.g., overboard so it is no longer in the bilge 12. The pump 16 may take the form of a diaphragm pump, including a self-priming diaphragm pump, which is known in the art, although the scope of the invention is intended to include other types or kinds of pumps either now known or later developed in the future. The pump 16 includes a motor 16*a* and other pump components 16*b*, including, e.g., a controller circuit for turning the motor 16*a* on/off. In FIG. 1*b*, the load sensing circuit board is generally indicated by arrow 18, is arranged inside a junction box JB, is identified as element B, has wiring w1 for coupling the load sensing circuit board B to the pump 16, and has wiring w2 for coupling the load sensing circuit board B to a power supply (not shown), including a battery located on the vessel 10. (Hereinafter, the load sensing circuit board may be interchangeably referred to by reference label B or 18.) According to some embodiments of the present invention, either the entire bilge pump system 14 or just the pump 16 may be configured in the bilge 12 of the vessel 10. The pump 16 is configured to respond to signaling from the load sensing circuit board 18 via the wiring w1 to be activated at predetermined intervals, and is also configured to respond to corresponding signaling from the load sensing circuit board 18 via the wiring w1 to be deactivated.

In FIG. 2, the load sensing circuit board 18 includes a signal processing module 20 and other load sensing circuit board components or circuits 18*a*, e.g., including a circuit or component for sensing the amperage draw of the motor 16*a* and providing a signal containing information about the same. The other load sensing circuit board components or circuits 18*a* may also include, e.g., other circuits or components for exchanging signaling along a signal path 19 (i.e. the wiring w1 (FIG. 1*b*)) with the pump 16. The signal processing module 20 is configured with at least one processor 22 and at least one memory 24 including computer program code. In operation, the at least one memory 24 and computer program code are configured, with the at least one processor 22, to cause the signal processing module 20 at least to:

provide the signaling to activate the pump 16 at the predetermined intervals, and receive a signal along the signal path 19 (i.e. the wiring w1 (FIG. 1*b*)) containing information about an amperage draw from the motor when the pump 16 is activated and either (1) continue to run the pump 16 or (2) provide the corresponding signaling to stop the pump 16 from running based at least partly on the signal received that contains information about the amperage draw sensed.

Implementation of the Functionality of the Circuit Board or Signal Processing Module 20

The functionality of the signal processing module 20 may be implemented using hardware, software, firmware, or a combination thereof, although the scope of the invention is not intended to be limited to any particular embodiment thereof. In a typical software implementation, the signal processing module 20 would be one or more microprocessor-based architectures having a microprocessor, a random access memory (RAM), a read only memory (ROM), the RAM and ROM together forming at least part of the memory 24, input/output devices and control, data and address buses connecting the same. A person skilled in the art would be able to program such a microprocessor-based implementation to perform the functionality described herein without undue experimentation. The scope of the invention is not intended to be limited to any particular implementation using technology now known or later developed in the future. Moreover, the scope of the invention is intended to include the signal processing module 20 being a stand alone module, or in some combination with other circuitry for implementing another module.

The signal processing module 20 may include one or more other sub-modules for implementing other functionality that is known in the art, but does not form part of the underlying invention per se, and is not described in detail herein. For example, the functionality of the one or more other modules may include the techniques for the provisioning of the signal for activating or deactivating the pump based on certain processing control functionality, including providing the signal automatically, providing the signal after a certain time period, etc., that can depend on a particular application for a particular customer.

Scope of the Invention

Although described in the context of particular embodiments, it will be apparent to those skilled in the art that a number of modifications and various changes to these teachings may occur. Thus, while the invention has been particularly shown and described with respect to one or more preferred embodiments thereof, it will be understood by those skilled in the art that certain modifications or changes, in form and shape, may be made therein without departing from the scope and spirit of the invention as set forth above.

I claim:

1. Apparatus, including a bilge pump system, comprising:

a self-priming diaphragm pump having a motor, and configured to respond to signaling to activate the self-priming diaphragm pump at predetermined intervals, and also configured to respond to corresponding signaling to deactivate the self-priming diaphragm pump; and a signal processing module configured with at least one processor and at least one memory including computer program code, the at least one memory and computer program code configured, with the at least one processor, to cause the signal processing module at least to:

provide the signaling to activate the self-priming diaphragm pump at the predetermined intervals, and receive a signal containing information about an amperage draw from the motor when the self-priming diaphragm pump is activated and either (1) continue to run the self-priming diaphragm pump or (2) provide the corresponding signaling to stop the self-priming diaphragm pump from running based at least partly on the signal received that contains information about the amperage draw sensed.

2. Apparatus according to claim 1, wherein the signal processing module forms part of a load sensing circuit board that is configured to couple to the self-priming diaphragm pump.

3. Apparatus according to claim 1, wherein the signal processing module is configured to activate the pump at predetermined intervals for 1-3 seconds.

4. Apparatus according to claim 1, wherein the apparatus comprises a vessel having a bilge, and either the bilge pump system or the self-priming diaphragm pump is configured in the bilge.

5. Apparatus according to claim 4, wherein the bilge is the lowest compartment on the vessel and is located where the two sides of the vessel meet at the keel.

6. Apparatus, including a vessel, comprising:

a bilge configured at the lowest compartment on the vessel and located where the two sides of the vessel meet at the keel; and a bilge pump system configured with a self-priming diaphragm pump and a signal processing module, either the bilge pump system or the self-primimg diaphragm pump being configured in the bilge, the self-primimg diaphragm pump having a motor, and being configured to respond to signaling to be activated at predetermined intervals, and also configured to respond to corresponding signaling to be deactivated, and the signal processing module being configured with at least one processor and at least one memory including computer program code, the at least one memory and computer program code configured, with the at least one processor, to cause the signal processing module at least to:

provide the signaling to activate the self-priming diaphragm pump at the predetermined intervals, and receive a signal containing information about an amperage draw from the motor when the self-primimg diaphragm pump is activated and either (1) continue to run the self-priming diaphragm pump or (2) provide the corresponding signaling to stop the self-priming diaphragm pump from running based at least partly on the signal received that contains information about the amperage draw sensed.

7. A vessel according to claim 6, wherein the signal processing module is configured to activate the pump at predetermined intervals for 1-3seconds.

8. Apparatus according to claim 6, wherein the signal processing module forms part of a load sensing circuit board that is configured to couple to the self-priming diaphragm pump.

9. Apparatus, including a bilge pump system, comprising:

a pump having a motor, and configured to respond to signaling to activate the pump at predetermined intervals, and also configured to respond to corresponding signaling to deactivate the pump; and a signal processing module configured with at least one processor and at least one memory including computer program code, the at least one memory and computer program code configured, with the at least one processor, to cause the signal processing module at least to:

provide the signaling to activate the pump at the predetermined intervals for 1-3 seconds, and receive a signal containing information about an amperage draw from the motor when the pump is activated and either (1) continue to run the pump or (2) provide the corresponding signaling to stop the pump from running based at least partly on the signal received that contains information about the amperage draw sensed.

10. Apparatus according to claim 9, wherein the signal processing module forms part of a load sensing circuit board that is configured to couple to the pump.

11. Apparatus according to claim 9, wherein the pump is a diaphragm pump.

12. Apparatus according to claim 9, wherein the pump is a self-priming diaphragm pump.

13. Apparatus according to claim 9, wherein the apparatus comprises a vessel having a bilge, and either the bilge pump system or the pump is configured in the bilge.

14. Apparatus according to claim 13, wherein the bilge is the lowest compartment on the vessel and is located where the two sides of the vessel meet at the keel.

15. Apparatus, including a vessel, comprising:

a bilge configured at the lowest compartment on the vessel and located where the two sides of the vessel meet at the keel; and a bilge pump system configured with a pump and a signal processing module, either the bilge pump system or the pump being configured in the bilge, the pump having a motor, and being configured to respond to signaling to be activated at predetermined intervals, and also configured to respond to corresponding signaling to be deactivated, and the signal processing module being configured with at least one processor and at least one memory including computer program code, the at least one memory and computer program code configured, with the at least one processor, to cause the signal processing module at least to:

provide the signaling to activate the pump at the predetermined intervals for 1-3 seconds, and receive a signal containing information about an amperage draw from the motor when the pump is activated and either (1) continue to run the pump or (2) provide the corresponding signaling to stop the pump from running based at least partly on the signal received that contains information about the amperage draw sensed.

16. A vessel according to claim 15, wherein the pump is a diaphragm pump.

17. A vessel according to claim 15, wherein the pump is a self-priming diaphragm pump.

18. Apparatus according to claim 15, wherein the signal processing module forms part of a load sensing circuit board that is configured to couple to the pump.

* * * * *